United States Patent [19]

Phillips

[11] 4,104,994

[45] Aug. 8, 1978

[54] CHARGE FORMING METHOD AND APPARATUS WITH ACCELERATING SYSTEM

[75] Inventor: Bernard C. Phillips, Toledo, Ohio

[73] Assignee: Borg-Warner Corporation, Chicago, Ill.

[21] Appl. No.: 719,456

[22] Filed: Sep. 1, 1976

[51] Int. Cl.[2] ..... F02B 33/04; F02M 37/00

[52] U.S. Cl. ..... 123/73 R; 123/119 B; 261/35; 261/DIG. 68

[58] Field of Search ..... 123/73 R, 73 A, 119 B; 261/DIG. 68, 35

[56] References Cited

U.S. PATENT DOCUMENTS

| | | | |
|---|---|---|---|
| 2,012,564 | 8/1935 | Holmes | 261/DIG. 51 |
| 2,733,902 | 2/1956 | Phillips | 261/DIG. 68 |
| 2,796,838 | 6/1957 | Phillips | 123/119 R |
| 3,072,390 | 1/1963 | Phillips | 261/DIG. 68 |
| 3,170,006 | 2/1965 | Brown | 261/DIG. 68 |
| 3,181,843 | 5/1965 | Brown et al. | 261/DIG. 68 |
| 3,633,557 | 1/1972 | Tuckey et al. | 261/DIG. 68 |
| 3,743,254 | 7/1973 | Tuckey | 261/DIG. 68 |
| 3,765,657 | 10/1973 | DuBois | 261/DIG. 68 |

*Primary Examiner*—Charles J. Myhre
*Assistant Examiner*—David D. Reynolds
*Attorney, Agent, or Firm*—Harry O. Ernsberger

[57] ABSTRACT

The disclosure embraces a charge forming apparatus or carburetor embodying a fuel aspirating system and method of operation thereof wherein the charge forming apparatus comprises a body construction having a mixing passage, a fuel chamber and aperture means for delivering fuel into the mixing passage, the fuel aspirating system utilizing a jet of gas projected across the aperture means and being of sufficient velocity for aspirating fuel from the aperture means into the mixing passage effective for improved engine operation, engine acceleration purposes and efficient fuel metering.

21 Claims, 25 Drawing Figures

CHARGE FORMING METHOD AND APPARATUS WITH ACCELERATING SYSTEM

One of the difficulties encountered in the use of charge forming apparatus or carburetors, particularly those of the aspirated diaphragm type, is to obtain delivery of fuel from a main discharge orifice or port into the mixing passage when the throttle is partially or fully opened from an engine idling position to rapidly accelerate or increase engine speed. The difficulty is aggravated with the present trend in carburetor constructions for use with two cycle internal combustion engines of enlarging a mixing passage in order to obtain increased power from the engine.

In the prior art, the air valve type carburetor offered a solution for the acceleration problem from low engine speeds. Multiple Venturies have been utilized with limited success. Mechanically operated accelerating pumps have been employed but such constructions are costly and are not entirely satisfactory because the fuel discharge from the accelerating pump is usually of short duration and, if the engine speed is not increased enough to increase the aspiration on the main fuel discharge orifice to deliver the required amount of fuel, sluggish acceleration will result. Such devices have not solved the problem satisfactorily in carburetors wherein fuel is aspirated from a diaphragm fuel chamber into a mixing passage by engine aspiration.

Diaphragm carburetors have been developed wherein pulse pressure from an engine crankcase of a two cycle engine has been used as a pressure means in a fuel channel for forcing fuel delivery through a main orifice of a diaphragm-type carburetor with some success in effecting acceleration of an engine but the pressure projection of fuel from the orifice means is of limited duration and usually ceases before normal aspiration is established in the mixing passage to effect delivery of fuel by aspiration into the mixing passage.

The present invention embraces a method or system of effecting delivery of liquid fuel from a fuel chamber through an aperture means into a mixing passage of a charge forming apparatus or carburetor by projecting a stream or jet of gas from a nozzle across the discharge region of the aperture means for aspirating fuel from the aperture means into the mixing passage for attaining improved engine operation.

The present invention embraces a method of effecting delivery of liquid fuel through an aperture means into a mixing passage of a charge forming apparatus by projecting or directing a stream or jet of gas from a nozzle across the discharge region of the aperture means for aspirating fuel through the aperture means into the mixing passage when the throttle is opened from an engine idling position to effect rapid acceleration of the engine.

An object of the invention resides in a method of promoting or increasing delivery of liquid fuel through a main fuel delivery aperture means into a mixing passage of a charge forming apparatus at low engine speeds by projecting a jet or stream of gas from a nozzle across the aperture means for aspirating fuel thereby to enrich the fuel and air mixture when the aspiration in the mixing passage is comparatively weak or insufficient to provide an effective mixture for engine operation.

An object of the invention resides in the provision of an accelerating system for a carburetor or charge forming apparatus particularly for use with a two cycle engine wherein pulse pressure in the engine crankcase is utilized to project a stream or jet of air or gases from the engine crankcase across an aperture means for delivering fuel from a fuel chamber through the aperture means into the mixing passage of the charge forming apparatus or carburetor providing fuel in sufficient amount and discharge duration to rapidly accelerate the engine to normal or high speed operation.

Another object of the invention resides in the provision of an accelerating system for a carburetor or charge forming apparatus having a mixing passage and a fuel delivery aperture means particularly for use with a two cycle engine wherein gases in the engine crankcase are projected across the fuel delivery aperture means in a manner to aspirate fuel from a fuel chamber into the mixing passage when the throttle valve in the mixing passage is opened to thereby aspirate fuel into the mixing passage for effecting rapid acceleration of the engine with which the charge forming apparatus or carburetor is used.

Another object of the invention resides in the use of gases under pressure in the crankcase of a two cycle engine conveyed to a nozzle adjacent fuel delivery aperture means opening into a mixing passage of the carburetor wherein the delivery of gas under pressure to the aspirating nozzle is controlled by a means associated with the throttle valve in the mixing passage whereby aspiration of the jet becomes effective upon opening movement of the throttle valve.

Another object of the invention resides in a carburetor of the diaphragm type having a mixing passage and a fuel delivery nozzle opening into the mixing passage wherein gases under pressure in the crankcase are conveyed to a nozzle means for aspirating fuel into the mixing passage under the velocity of the gases projected from the nozzle wherein the passage means for conveying the gases to the nozzle means embodies one-way valve or check valve means effective to transmit pressure pulses to the nozzle means promoting efficient aspiration of fuel into the mixing passage.

Another object of the invention resides in a carburetor of the diaphragm type usable with a two cylinder, two cycle engine wherein the carburetor embodies fuel delivery aperture means for delivering fuel into the mixing passage of the carburetor, the carburetor having nozzle means for projecting a stream or jet of gases from the crankcase of the two cylinder engine for aspirating fuel from the aperture means into the mixing passage, the means for conveying gases from the crankcase to the carburetor embodying dual valve means operable for conveying successive alternate gas pressure pulsations to the nozzle means in the carburetor for establishing a substantially continuous stream of gases delivered from the nozzle for improving the operation of the engine.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 1:
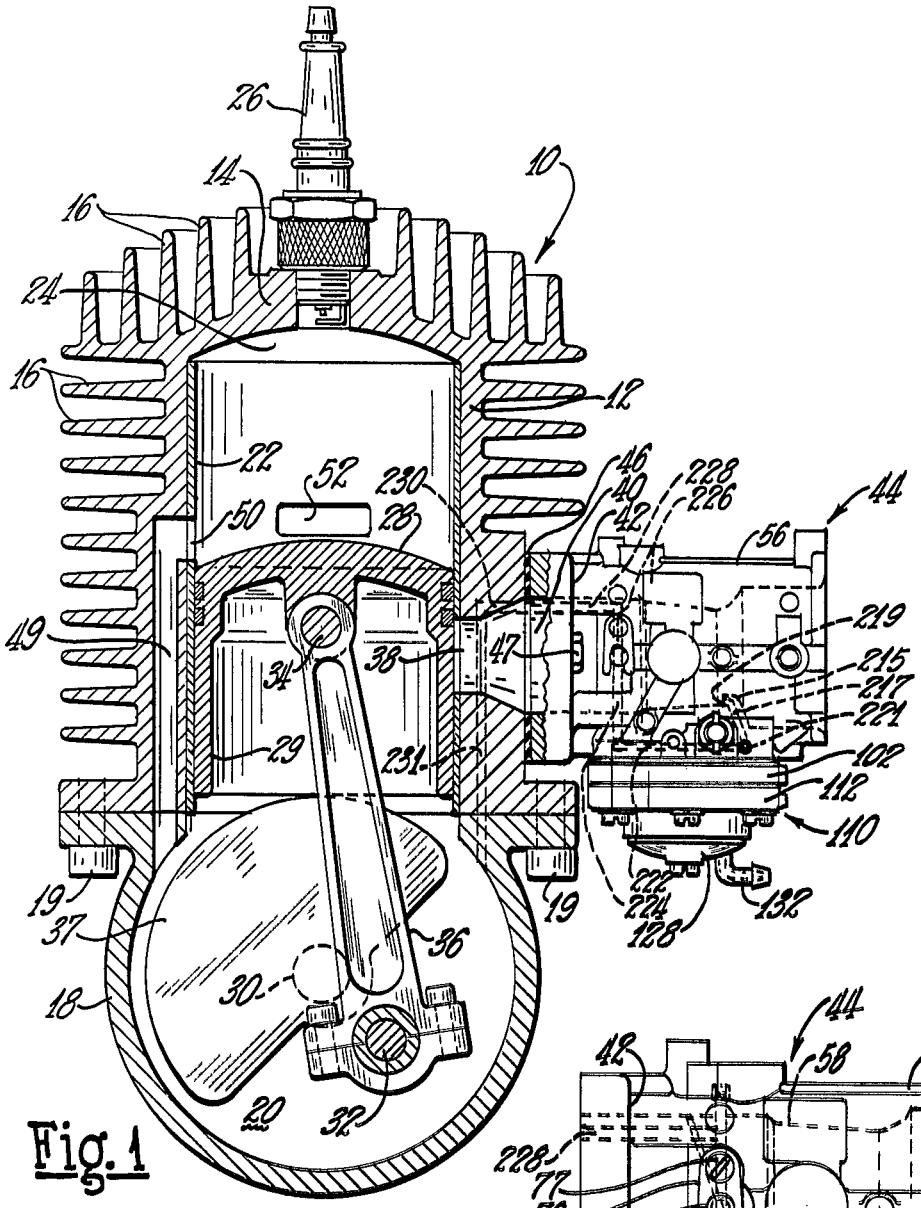
FIG. 1 is a semischematic sectional view of a single cylinder, two cycle engine illustrating a form of carburetor of the invention associated with the engine.

Referring to the drawings and initially to FIG. 1, there is illustrated in semischematic form a two cycle engine of the three port type in association with a carburetor or charge forming apparatus of the aspirated diaphragm type embodying a form of the invention and adapted to supply a combustible mixture of fuel and air to the engine. The carburetor shown in FIG. 1 is further illustrated in FIGS. 2 through 9.

The two cycle engine 10 illustrated in FIG. 1 is of the single-cylinder air-cooled type which includes a cylinder 12 having a head 14, the cylinder and head being provided with cooling fins 16. The cylinder 12 is joined with a crankcase 18 by bolts 19 or other suitable means, the crankcase providing a crankcase chamber 20.

The cylinder and crankcase are preferably fashioned of comparatively lightweight metal, such as an alloy of aluminum, the cylinder preferably having an interior sleeve or liner 22 of steel or other wear-resistant metal. The cylinder head 14 is shaped to form a combustion chamber 24, the head having a threaded opening accommodating a conventional spark plug 26. A piston 28 having a skirt portion 29 is reciprocable in the cylinder.

Journally mounted in suitable bearings in the wall of the crankcase 18 is a crankshaft 30 equipped with a crank arm having a crank pin 32. The piston 28 is provided with a wrist pin 34 connected with the crank pin 32 by a conventional connecting rod 36. The crankshaft is fashioned with a conventional counterweight 37.

The engine illustrated in FIG. 1 is of the so-called three-port type, the cylinder wall and liner sleeve 22 having a mixture inlet port 38, the port 38 mating with a passage 40 in a mounting flange 42 of a charge forming apparatus or carburetor 44, a gasket 46 of heat insulating material being disposed between the engine cylinder and the mounting flange 42. The mounting flange 42 is secured to the engine cylinder by bolts 47, one of which is shown in FIG. 1, the bolts extending through mating openings in the mounting flange and gasket 46 into threaded openings in the cylinder wall.

The cylinder wall is provided with a passage or channel 49, the upper end of the channel being in communication with a port 50, its lower end opening into the crankcase chamber 20. The channel 49 conveys a mixture of fuel and air from the crankcase chamber 20 into the cylinder above the head of the piston 28. An exhaust port 52 is provided in the cylinder wall and sleeve 22 through which the spent gases of combustion are exhausted from the cylinder at the completion of each power stroke of the piston 28.

The carburetor is adapted to provide a fuel and air mixture for delivery to the engine crankcase chamber 20 during each revolution of the engine crankshaft. The operation of the two cycle engine illustrated in FIG. 1 is as follows:

A fuel and air mixture formed in the mixing passage of the carburetor is supplied to the crankcase chamber 20 through the inlet port 38 in the cylinder wall and sleeve 22 when the piston is in an uppermost position uncovering the port 38.

As the piston 28 moves downwardly, the fuel and air mixture is compressed in the crankcase chamber 20 and, as the piston approaches its lowermost position, the compressed mixture in chamber 20 flows through passage 49 and port 50 into the combustion chamber above the piston. The incoming fuel and air mixture assists in scavenging the exhaust gases resulting from the previous combustion of mixture in thecombustion chamber through the port 52 as is conventional in two cycle engines.

The piston 28 moving upwardly on a compression stroke closes the port 50 and the exhaust port 52 and the fuel and air mixture compressed in the combustion chamber 24. The piston 28 moving upwardly establishes reduced pressure or partial vacuum in the crankcase chamber 20 and when the piston skirt 29 moving upwardly uncovers the port 38, a charge of fuel and air is admitted from the carburetor into the crankcase chamber 20. When the piston 28 is approximately at its uppermost position, the spark plug 26 ignites the compressed mixture in the combustion chamber 24 forcing the piston 28 downwardly on a power stroke.

As the piston moves downwardly, the skirt 29 closes the mixture inlet port 38. For purposes of illustration, in FIG. 1 the exhaust port 52 is shown as disposed about ninety degrees from the port 50, but in actual construction the exhaust port 52 is preferably diametrically opposite to the port 50 so that the mixture flowing into the cylinder through the port 50 assists in scavenging exhaust gases through the port 52. The above described cycle of operation occurs during each revolution of the engine crankshaft 30.

Figure 6:
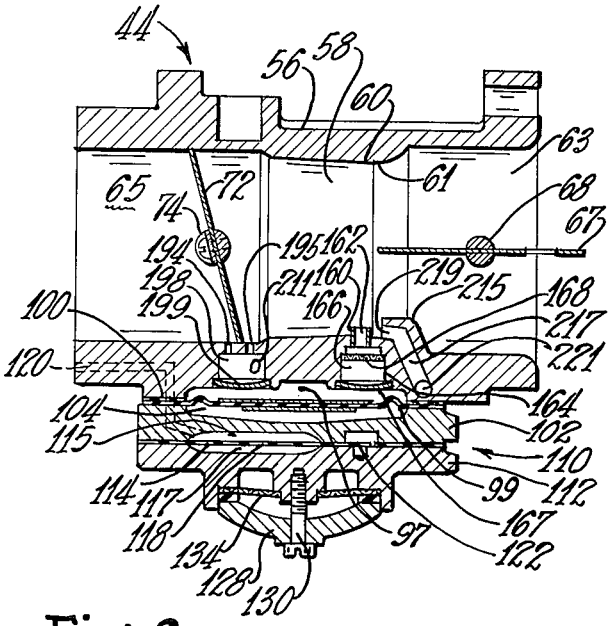
FIG. 6 is a longitudinal sectional view taken substantially on the line 6—6 of FIG. 3.
Figure 7:
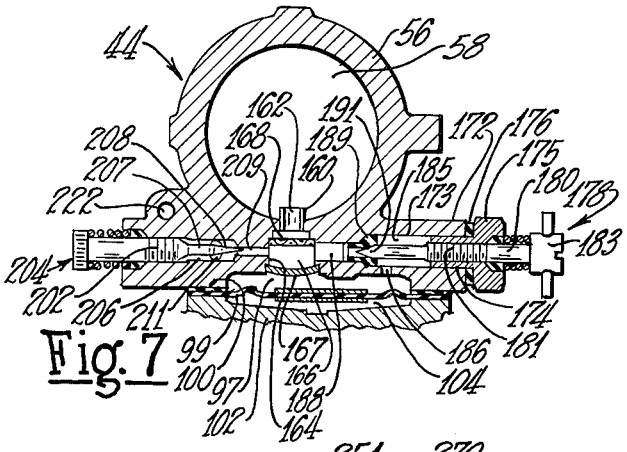
FIG. 7 is a transverse fragmentary sectional view taken substantially on the line 7—7 of FIG. 3.
Figure 8:
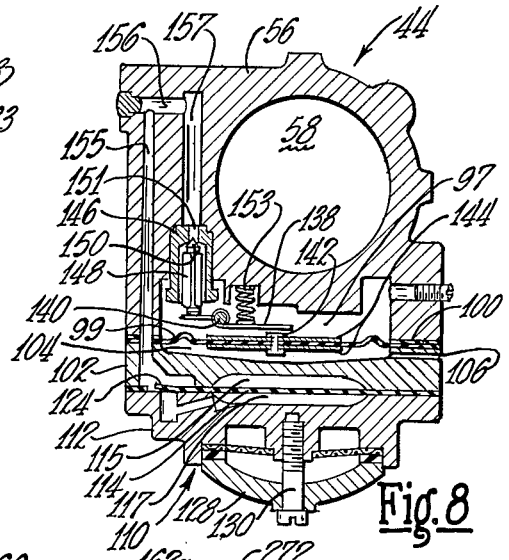
FIG. 8 is a transverse fragmentary sectional view taken substantially on the line 8—8 of FIG. 3.

The carburetor 44 embodying a form of the invention is illustrated in FIGS. 1 through 9. The carburetor illustrated is of the aspirated diaphragm type and includes a body 56 fashioned with a fuel and air mixing passage 58 of circular cross section as shown in FIGS. 7 and 8. The mixing passage preferably includes a Venturi 60 having a restricted region or choke band 61, an air inlet region 63 and a mixture outlet region 65.

Figure 3:
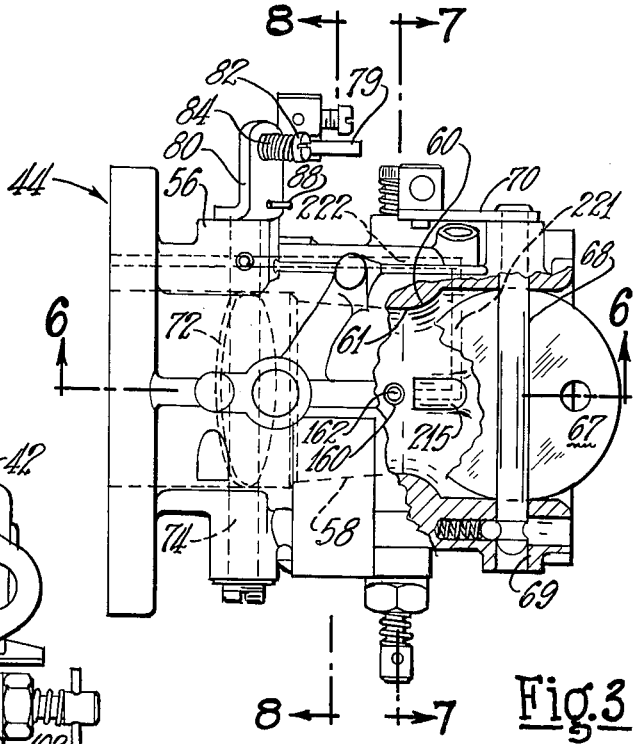
FIG. 3 is a top plan view of the carburetor shown in FIG. 2 with certain portions broken away for purposes of illustration.

The air inlet end of the carburetor body 56 is preferably equipped with an air filter (not shown) of conventional construction. Disposed in the air inlet region 63 is a choke valve 67 mounted on a shaft 68 journaled in suitable bores 69 in the carburetor body as shown in FIG. 3. An end of the shaft exteriorly of the body is provided with an arm 70 for manipulating the choke valve for engine starting purposes.

Figure 2:
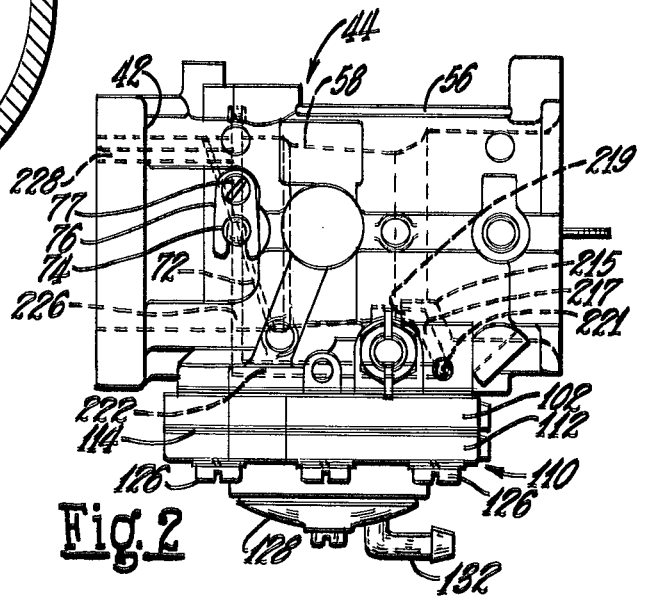
FIG. 2 is an elevational view of the carburetor illustrated in FIG. 1.

Disposed in the outlet region 65 of the mixing passage is a disc type throttle valve 72 secured on an operating shaft 74. One end of the throttle operating shaft 74 extends exteriorly of the carburetor body and has a circumferential groove receiving the bifurcated region of a retaining clip 76 as shown in FIG. 2. The clip 76 is secured to the carburetor body by a retaining screw 77, the clip preventing endwise movement of the throttle shaft 74.

Figure 4:
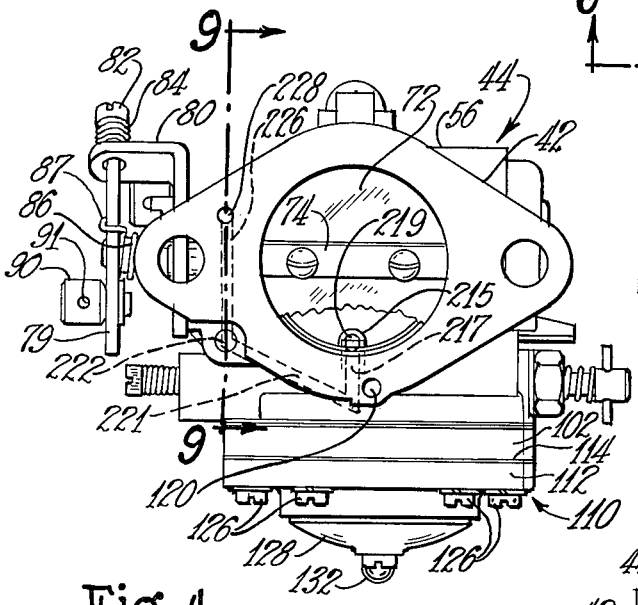
FIG. 4 is an end view from the engine-mounting end of the carburetor.
Figure 5:
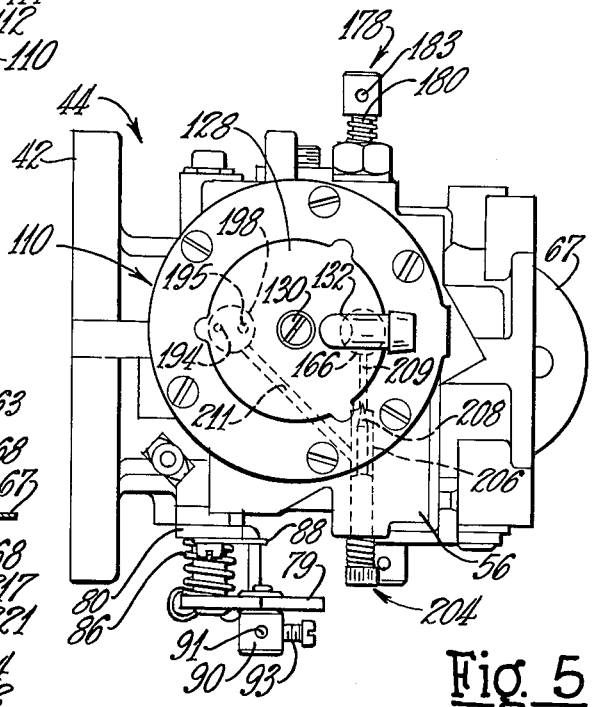
FIG. 5 is a bottom plan view of the carburetor.

Secured to the opposite end region of the shaft 74 exteriorly of the body 44 is an arm 79, shown in FIGS. 3, 4 and 5, for manipulating the throttle valve 72. Secured to the body 44 is an L-shaped member 80, one leg of the member 80 having a screw 82 which is engaged by the arm 79 when the throttle valve 72 is in near closed or engine idling position. By adjusting the screw 82, the engine idling position of the throttle valve 72 may be regulated.

A coil spring 84 between the head of the screw 82 and the member 80 provides friction to retain the screw 82 in adjusted position. Surrounding the throttle shaft 74 exteriorly of the carburetor body is a coil spring 86 having one end 87 hooked over or engaged with the arm 79, the other end 88 of the coil spring being hooked over the member 80 as shown in FIGS. 3 and 5.

The tension of the coil spring 86 biases the throttle valve 72 toward engine idling position. Journaled on the arm 79 is a cylindrical member 90 having an opening 91 to receive a throttle operating wire, cable or other means for operating the throttle from a remote position. The wire or operating means is secured to the member 90 by a setscrew 93.

As particularly shown in FIG. 8, the carburetor body 56 is formed with a comparatively shallow, generally circular recess providing a fuel chamber 97, a flexible membrane or diaphragm 99 extending across the recess providing a flexible wall of the fuel chamber 97. An annular gasket 100 is disposed between the peripheral region of the diaphragm 99 and the carburetor body 56. A member 102 is disposed beneath the diaphragm 99 and is fashioned with a central circular recess 104 providing a space or dry chamber to accommodate flexing movements of the diaphragm 99. The space 104 is vented to the atmosphere by a vent passage 106 shown in FIG. 8.

Associated with the carburetor illustrated in FIGS. 1 through 8 is a diaphragm-type fuel pump construction 110 secured to the carburetor body. The fuel pump construction 110 may be of conventional construction such as the pulse pressure operated diaphragm fuel pump illustrated in Phillips U.S. Pat. No. 2,796,838. Disposed beneath the member 102 is a member 112, a pumping diaphragm 114 being disposed between the members 102 and 112. The member 102 is fashioned with a shallow cavity 115 of substantially circular configuration and the member 112 is fashioned with a similarly shaped recess or cavity 117 providing a fuel chamber.

An area or region 118 of the pumping diaphragm adjacent the chambers 115 and 117 is vibrated or actuated by gas pressure pulses set up in the engine crankcase chamber 20 during engine operation. The pumping chamber 115 is connected with a passage 120, as shown in broken lines in FIG. 6, opening at the mounting flange 42, as shown in FIG. 4, which is in registration with a passage (not shown) in the wall of the crankcase whereby gas pressure pulses in the crankcase are transmitted through the passage 120 into the pumping chamber 115 to actuate or vibrate the area or region 118 of the diaphragm 114.

The pumping diaphragm 114 is fashioned with flap valves, one of the flap valves 122, shown in FIG. 6, controls flow of fuel into the fuel chamber 117, and a second flap valve 124 controls fuel flow out of the fuel chamber 117. The metering diaphragm 99, members 102 and 112 and the pumping diaphragm 114 are secured in assembled relation by screws extending through openings in these components into threaded bores in the carburetor body 56.

A closure 128 is secured to member 112 by a screw 130 as shown in FIGS. 6 and 8. The closure 128 has a nipple portion 132 connected with a fuel supply tank by a flexible tube (not shown) in a conventional manner. Disposed between the closure 128 and member 112 is a fuel filter or screen 134 for filtering incoming liquid fuel.

Disposed in the fuel chamber 97 in the body 56 is a lever 138 fulcrumed intermediate its ends upon a pin 140 mounted by the carburetor body 56. The end region of the long arm of the lever 138 is arranged to be engaged by the head of a rivet 142 mounted at the central region of the metering diaphragm 99. Reinforcing discs 144 are disposed at each side of the diaphragm 99, the rivet 142 securing the discs in assembly with the diaphragm.

The carburetor body is provided with a bore in which is snugly received a valve cage or guide means 146 in which is slidably disposed a fuel inlet valve 148. The short arm of the lever 138 engages the fuel inlet valve 148 as shown in FIG. 8. The valve 148 has a needle valve portion 150 adapted to cooperate with a fuel inlet port 151.

An expansive coil spring 153 engages the lever adjacent the fulcrum pin 140 biasing the fuel inlet needle valve 150 to port-closing position. The body 56 is provided with interconnected fuel conveying passages 155, 156 and 157 for conveying fuel from the region of the flap valve 124 of the pump to the port 151, the fuel in these passages being under comparatively low pressure from the fuel chamber 117 of the fuel pump.

The carburetor or charge forming apparatus illustrated in FIGS. 1 through 10 embodies a fuel channel or passage system and orifice or aperture means for delivering liquid fuel into the mixing passage for engine idling and normal and high speed engine operation. The carburetor embodies a method of and means associated with a fuel delivery orifice or aperture for directing a jet or stream of gas across the orifice or aperture establishing aspiration effective to increase delivery of fuel into the mixing passage when the throttle is opened from engine idling position to accelerate the speed of the engine.

The main or primary fuel delivery system includes a tubular member or means 160 opening into the mixing passage, shown in FIGS. 3, 6 and 7, the outlet of the tubular member 160 providing a main orifice or aperture 162 through which fuel is delivered into the mixing passage. The tubular means 160 is in communication with a bore 164 which provides a fuel well 166 beneath the means 160. The lower end of the bore 164 is closed by a Welch plug 167.

A porous member or fine mesh screen 168 is disposed in the bore 164 adjacent the aperture means 162, the porous member or screen when wetted with fuel providing a capillary seal for preventing back bleeding of air through the aperture means 162 into the engine idling and low speed fuel delivery system when the latter is delivering fuel into the mixing passage as hereinafter described. Other means for preventing back bleeding through the aperture means into the engine idling and low speed fuel delivery system may be used such as the check valve means shown in the U.S. Pat. No. to Phillips 2,733,902. The main orifice 162 preferably opens into the mixing passage adjacent the choke band or restricted region 61 of the Venturi 60 as shown in FIG. 6.

With particular reference to FIG. 7, the carburetor body 56 is provided with a laterally extending boss 172 having a bore 173 in which is press fitted a tenon 174 of a bushing 175, a sealing gasket 176 being disposed between an enlarged portion of the bushing 175 and the end of the boss 172. A fuel adjusting valve means 178 for regulating fuel flow to the well or region 166 includes a valve body 180 having a threaded portion 181 engaged in a threaded bore in the bushing 175, the valve body having a manipulating head 183.

The bore 173 provides a fuel passage 185 which receives fuel from the fuel chamber 97 through a passage 186. The fuel passage 185 is in communication with a fuel passage 188, a tubular insert 189 between the passages 185 and 188 providing a valve seat for a needle valve portion 191 of the valve body 180. Fuel for delivery through the main orifice 162 is regulated by adjusting the valve means 178.

The carburetor body 56 is fashioned with a secondary fuel delivery system which includes an engine idling orifice or aperture 194 and a low speed orifice 195 opening into the mixing passage. The engine idling orifice 194, as shown in FIG. 6, is at the downstream or left-hand side of the throttle valve 80 illustrated in near closed or engine idling position. The orifices or apertures 194 and 195 are in communication with a small supplemental fuel chamber 198, the lower end of which is closed by a Welch plug 199.

With reference to FIG. 7, the body 56 is fashioned with a threaded bore which receives a threaded portion 202 of an adjustable valve means 204 for regulating fuel flow to the engine idling and low speed orifices. A region 206 of the bore accommodating the valve body receives a tenon portion 207 of the valve body, the latter terminating in a needle portion 208 which extends into and cooperates with a fuel passage 209 in communication with the fuel well or region 166 as shown in FIG. 7.

A passage 211, shown in FIGS. 5, 6 and 7, is in communication with the region 206 and the supplemental chamber 198 as shown in broken lines in FIG. 5. The fuel for engine idling and low speed purposes is derived from the region or well 166, the fuel flowing through passage 209 past the adjustable needle valve 208 through region 206 and passage 211 into the supplemental chamber 198.

The fuel for delivery through the main orifice and through the engine idling and low speed orifices flows past the adjusting needle valve 191 into the well or region 166. Fuel flows from the well 166 through passage 209 past the low speed adjusting needle valve 208 to the supplemental chamber 198 for delivery from the engine idling and low speed orifices 194 and 195. Such arrangement is termed a dependent idle system as the fuel for the engine idling and low speed system as well as the fuel for delivery through the main orifice 162 flows past the high speed adjusting needle valve 191.

The invention embraces a method or system of effecting increased delivery of liquid fuel into the mixing passage for engine acceleration when the throttle is moved toward open position. The increased delivery of fuel is accomplished by projecting a stream or jet of gas across the discharge region of the main fuel delivery aperture or orifice for aspirating fuel from the main orifice or aperture to provide a power mixture for the engine when the engine aspiration in the mixing passage at low engine speed is at a low level or at a level insufficient to effect the discharge of an adequate amount of fuel into the mixing passage to obtain a rapid increase or acceleration of engine speed.

Gas under pressure providing the stream or jet of gas across the fuel delivery orifice or aperture is preferably derived from the crankcase of the two cycle internal combustion engine with which the carburetor or charge forming apparatus is used. The pressure pulses occurring in the engine crankcase at each revolution of the engine cause the gases to flow from an aspirating nozzle providing the pressure jet or stream of gas of a velocity to aspirate fuel from the orifice or aperture 162 to enrich the mixture in the mixing passage.

The pressure stream or jet of gas is directed close to and across the fuel delivery orifice 162 in a direction downstream of the mixing passage. With particular reference to FIGS. 1, 2, 3 and 6, the carburetor body 56 is fashioned with a raised portion 215 extending into the mixing passage and terminating adjacent but just short of the aperture means 162. The body 56 is fashioned with a passage 217 having an outlet or nozzle 219, as shown in FIG. 6, which is adapted to project or deliver a stream of gas across the aperture 162 for aspirating fuel from the aperture means into the mixing passage.

Figure 10:
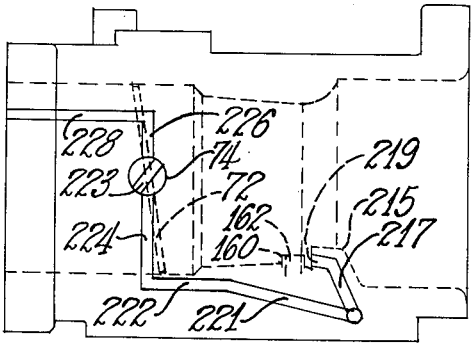
FIG. 10 is a semischematic view of the carburetor shown in FIGS. 1 and 2 illustrating a pulse pressure conveying channel system.
Figure 9:
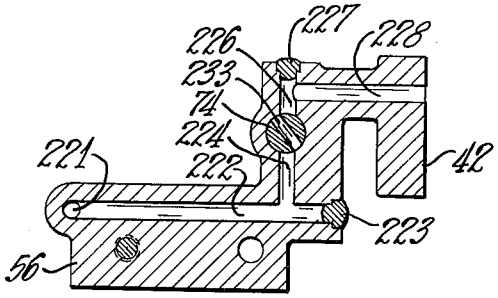
FIG. 9 is a fragmentary detail sectional view taken substantially on the line 9—9 of FIG. 4.

The passage 217 is in communication with a passage 221 which is in communication with a passage 222, the passages 221 and 222 being shown in broken lines in FIGS. 1, 2 and 3 and shown schematically in FIG. 10. As shown in FIGS. 9 and 10, and in broken lines in FIGS. 1 and 2, the passage 222 is in communication with a passage 224 which is aligned with a short passage 226. The short passage 226 is in communication with a passage 228 opening at the mounting flange 42. One end of passage 222 is closed by a plug 223, and the upper end of passage 226 is closed by a plug 227.

As shown in broken lines in FIG. 1, the passage 228 registers with a passage 230 which is in communication with a passage 231 opening into the engine crankcase 18 as illustrated in FIG. 1. With particular reference to FIGS. 9 and 10, the throttle shaft 74 extends transversely of and between the aligned passages 224 and 226. The gas flow established by the crankcase pulse pressure is valved by a portion of the throttle valve shaft 74, the shaft 74 being provided with a port or passage 233.

In a near closed or engine idling position of the throttle valve 72, the passage 233 is out of registration with the aligned passages 224 and 226 as shown in FIGS. 9 and 10. During opening movement of the throttle valve, shaft 74 is rotated to move port 233 to a position into registration with passages 224 and 226 allowing gases under crankcase pressure pulses to pass from the crankcase through passages 228, 226, port 233 in the throttle shaft 74, through passages 224, 222, 221 and 217 whereby the gases, such as air or a mixture of fuel vapor and air, are delivered at substantial velocity from the nozzle 219 at the terminus of the passage 217.

As the throttle valve 72 is moved toward open position, the velocity of the projected gas stream from the orifice 219 aspirates fuel out of the orifice 162 into the mixing passage. The passage system accommodates gas flow under the influence of intermittent pressure pulses from the crankcase of the two cycle engine. The intermittent pressure pulses are of greater magnitude than the reduced pressure or partial vacuum periods under open throttle conditions so that while the pressure pulses are intermittent, the pressure pulses are effective to provide a substantially constant stream of gas through the passage system delivered from the nozzle or exit 219, shown in FIG. 6, sufficient to aspirate fuel from the aperture or orifice 162 and thus enrich the mixture whenever the throttle is opened.

The velocity of the pressure stream of gas delivered from the nozzle 219 is sufficient to aspirate fuel from the orifice or aperture 162 to provide an enriched fuel and air mixture even though the air flow through the mixing passage is comparatively low during the initial opening movement of the throttle valve 72. The discharge of fuel from the main orifice 162 occurs more quickly under the aspirating action of the jet of gas from the nozzle 219 than under normal Venturi aspiration.

Through the aspirating effect of the stream of gas projected from the nozzle 219, fuel is delivered from the main orifice 162 for accelerating the engine as well as providing fuel in a well atomized state. At low engine speeds, without the aspirating jet, the main discharge orifice would normally deliver little, if any, fuel.

Another advantage in the use of the aspirating jet 219 is that it continues to aspirate fuel from the main orifice during the period that the engine is increasing in speed until normal aspiration by air flow through the Venturi of the mixing passage is sufficient to effect delivery of the required amount of fuel from the main orifice 162 for normal engine operation.

The gas stream from the nozzle 219 continues to effect delivery of fuel from the main aperture or orifice 162 but as the engine speed increases and normal Venturi aspiration in the mixing passage becomes as great or greater than the aspiration effect of the gas stream from the nozzle 219, then the aspiration of the gas stream from the nozzle 219 becomes ineffective.

In addition to providing for acceleration of the engine from low speeds, the fuel aspirating system tends to atomize the aspirated fuel, breaking up the fuel into small particles providing a fog or mist of the fuel which renders the mixture more homogeneous at low engine speeds and under heavy loads. Through the use of the aspirating jet of gas, a well atomized fuel is delivered into the Venturi air stream during the speed range of the engine in which fuel is aspirated from the jet 219.

Figure 11:
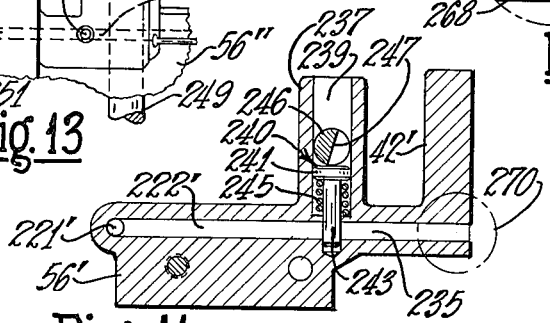
FIG. 11 is a detail sectional view similar to FIG. 9 illustrating a modified form of gas passage means and valve means for the aspirating nozzle.

FIG. 11 illustrates a modified arrangement associated with the throttle shaft for controlling flow of gases from the engine crankcase to the aspirating jet 219. In this form, the carburetor body 56' is fashioned with a passage 222', one end of which is in communication with the passage 221'. The opposite end 235 of the passage 221' opens at the face of the mounting flange 42' for connection with the crankcase chamber of a two cycle engine. The body 56' is provided with an upwardly extending portion 237, the throttle shaft 246 being disposed in a bore transversely of the mixing passage.

The body portion 237 is provided with a bore 239 which accommodates a valve means or member 240. The head portion 241 of member 240 snugly, yet slidably, fits within the bore and is in contact with the throttle shaft 246. The bore 239 does not intersect the passage 222'. The metal of the carburetor body below the end of the bore 239 is provided with a bore of lesser diameter which slidably receives a cylindrically-shaped tenon portion 243 of the valve member 240. The bore accommodating the tenon portion 243 extends across the passage 222' and projects a short distance into the body 56' below the passage 222'.

Disposed between the head 241 of the valve means 240 and the metal providing the bottom of the bore 239 is an expansive coil spring 245 which urges the valve member 240 into engagement with the throttle shaft 246. The throttle shaft 246, at the region of the valve means 240, is cut away or configurated to provide a flat surface or cam surface 247 approximately at the diameter of the shaft as shown in FIG. 11.

When the throttle is in near closed position the flat, planar or cam surface 247 of the throttle shaft is in the position shown in FIG. 11, the shaft holding the valve means 240 in a position wherein the tenon portion 243 of the valve means obturates or closes the passage 222' so that with the throttle in near closed or engine idling position, crankcase gases under pressure pulses do not flow to the aspirating jet 219 shown in FIGS. 6 and 10.

When the throttle 246 is moved toward open position, the flat surface or cam surface 247 is moved to a position permitting the valve 240 under the influence of spring 245 to move upwardly whereby the tenon 243 of the valve means 240 moves upwardly opening the passage 222' to permit gas under pulse pressures to flow through passages 222', 221' and passage 217, shown in FIG. 10, through the nozzle to aspirate fuel from the main orifice.

Figure 12:
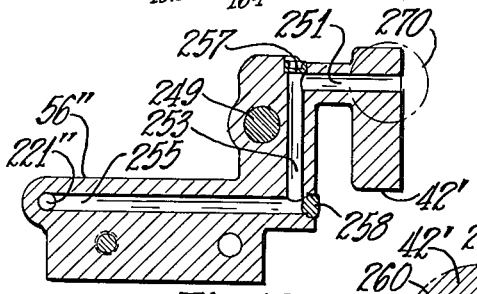
FIG. 12 is a sectional view illustrating another form of gas passage means for the aspirating nozzle.
Figure 13:
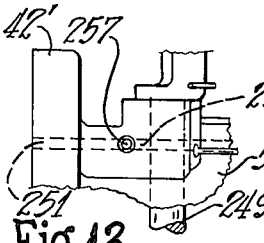
FIG. 13 is a detail plan view of a portion of the arrangement shown in FIG. 12.

FIGS. 12 and 13 illustrate an aspirating gas passage system whereby pulsing pressures in the engine crankcase effect flow of gases from the crankcase to an aspirating nozzle such as the nozzle 219, shown in FIGS. 6 and 10, without being valved through the medium of the throttle shaft. FIG. 12 illustrates a portion of a carburetor body 56'', the body having a mounting flange 42' for mounting on a two cycle engine.

The body 56'' is bored to accommodate a throttle shaft 249 which mounts a conventional disc-type throttle valve, such as the valve shown at 72 in FIG. 6, in a mixing passage. The carburetor body 56'' is provided with a passage 251 opening at the mounting flange 42' for registration with a passage in the cylinder wall of a two cycle engine such as the passage 230 shown in FIG. 1 which is in communication with the crankcase chamber.

The passage 251 is in communication with a drilled passage 253, and the passage 253 is in communication with a drilled passage 255. The passage 255 is in communication with a passage 221'' which is in communication with an aspirating nozzle such as the nozzle 219 shown in FIG. 6. The upper end of the passage 253 is closed by a plug 257 and one end of passage 255 is closed by a plug 258. In this form the passage system is independent of any valve means in a throttle shaft.

In the operation of the form shown in FIGS. 12 and 13 wherein the throttle valve is in near closed or engine idling position, the pulse pressure in the passage system is comparatively low and the velocity of the gas flowing from the aspirating nozzle 219 is comparatively low so that there is only a small aspirating effect on the primary fuel delivery port or aperture such as shown at 162 in FIG. 6.

As the throttle valve is moved toward open position and the engine speed increases, the pressure pulses causing flow of gas from the crankcase through the passage system to the aspirating nozzle, such as nozzle 219, are greatly increased so that the velocity of the gas stream delivered from the nozzle 219 is effective is aspirate fuel from the orifice or aperture 162 into the mixing passage providing a fuel-enriched accelerating mixture which rapidly increases engine speed.

This aspirating effect continues and as the air flow through the mixing passage increases, the air flow through the mixing passage becomes effective to aspirate fuel from the orifice or aperture 162. While still exerting an aspirating effect on the fuel delivery aperture, the stream or jet of gases does not effect fuel delivery at increased engine speeds because the velocity of the air flow through the mixing passage aspirates the fuel from the aperture 162 in a normal manner.

Figure 14:
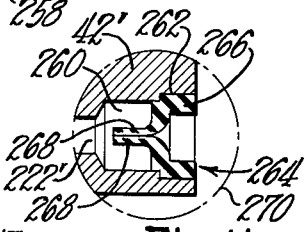
FIG. 14 is an enlarged fragmentary detail sectional view illustrating a form of check valve which may be used with the gas passage means.

FIG. 14 is an enlarged view illustrating one form of check valve or one-way valve that may be utilized in any of the passage systems disclosed herein for conveying gases from the engine crankcase to the aspirating jet. The mounting flange 42' is provided with a bore 260 in communication with the passage 222'. The mounting flange 42' is provided with a counterbore 262. Fitted into the counterbore 262 is a check valve or one-way valve construction 264 fashioned of synthetic rubber or other flexible material.

In the embodiment illustrated, the check valve 264 is provided with a circular portion 266 snugly fitted in the counterbore 262. Integrally formed with the circular portion 266 are two projecting portions or valve flaps 268 of rectangular cross section extending into the bore 260 and being normally in contiguous or contacting relation as shown in FIG.14. The portions 268 are comparatively thin and highly flexible or distortable. The projections 268 resemble a duck-bill-like configuration.

The projections 268 extend toward the entrance of passage 222' in the direction of flow of gases from a crankcase. The valve construction shown in FIG. 14 is embraced by a broken line circle 270, and such valve construction may be embodied in the construction shown in FIG. 11, or it may be embodied in the construction shown in FIG. 12, its positions being indicated by the broken line circles 270 in FIGS. 11 and 12.

In operation the check valve or one-way valve 264 permits gas flow in a left-hand direction as viewed in FIG. 14, the pressure of the gases flexing the valve portions or flaps 268 away from each other so that gases from the crankcase flow into the passage 222', shown in FIG. 11, or passage 251, shown in FIG. 12, for delivery from the nozzle 219 for aspirating fuel from the aperture 162. As the flaps or valve portions 268 are normally in contiguous contacting or closing position, as shown in FIG. 14, reverse flow of gas in the passage system is prevented.

As the valve portions or flaps 268 are highly flexible, they are readily flexed to open position by the pressure of the gases from the crankcase. The check valve or one-way valve construction provides against negative pressure pulses that occur by reason of reduced pressure or partial vacuum condition in the crankcase upon upward movement of the engine piston in the cylinder. It has been found that the use of a check valve in the gas passage system slightly increases the strength or efficiency of aspiration on the fuel delivery port or aperture.

Figure 15:
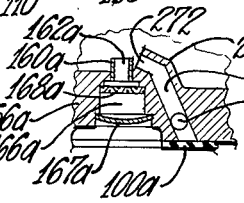
FIG. 15 is a detail sectional view illustrating a modified form of aspirating nozzle.

FIG. 15 is a fragmentary sectional view illustrating a modified position of the aspirating nozzle with respect to the fuel delivery aperture or orifice. The carburetor body **56*a* has a fuel delivery tube 160*a* providing a fuel delivery aperture or orifice 162*a*. The tube 160*a* is in communication with a fuel well 166*a*, the lower end of the well being closed by a plug 167*a*. A fine mesh screen or porous member 168*a* in the upper portion of the fuel well, when wetted by the fuel, provides a capillary seal for preventing back-bleeding of air through the aperture 162*a*** into the engine idling system when the latter is delivering fuel into the mixing passage.

The gas passage system is similar to that shown in FIG. 10 and is inclusive of a passage **221*a* in communication with a passage 217*a* which is in communication with a nozzle 272 formed in an angularly disposed raised portion 274 extending interiorly from a wall of the mixing passage of the carburetor. In this form, the angle of the nozzle with respect to the axis of the mixing passage is greater than the angle of the nozzle 219 with respect to the axis of the mixing passage, the nozzle 272 projecting a stream of gas from the crankcase across the fuel delivery aperture or port 162*a* at a greater angle with respect to the axis of the mixing passage than the angle of delivery of the nozzle 219 shown in FIG. 6**.

The passage **217*a* is drilled into the carburetor body 56*a* and the lower end of the passage is closed by the gasket 100*a*. This construction is advantageous where it is desired to diffuse the fuel aspirated from the fuel delivery aperture to a greater extent than the diffusion of fuel delivered from the nozzle 219 shown in FIG. 6**.

Figure 16:
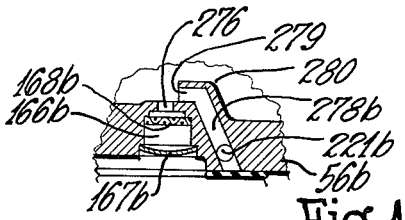
FIG. 16 is a view similar to FIG. 15 illustrating another form of aspirating nozzle.

FIG. 16 is a fragmentary sectional view similar to FIG. 15 illustrating a modified form of nozzle for delivering a stream of gas from a crankcase of a two cycle engine across a fuel delivery aperture or orifice in a wall of the mixing passage in a carburetor. In this form the carburetor body **56*b* has a fuel delivery aperture or orifice 276 which is a drilled opening in a wall of the mixing passage. A bore beneath the aperture 276 provides a fuel well 166*b*, the lower end of which is closed by a plug 167*b*. A fine mesh screen 168*b* in the upper region of the fuel well provides a capillary seal to prevent back-bleeding of air through the aperture 276** into the engine idling system when the latter is in operation.

The passage system for conveying gas from the crankcase of a two cycle engine into the mixing passage for aspirating fuel from the aperture 276 includes the passage **221*b* which is in communication with a passage 278 which is in communication with a nozzle 279 provided in a raised portion 280 in the mixing passage adjacent the aperture 276. The axis of the nozzle 279 is substantially normal or at a right angle to the axis of the fuel delivery aperture or port 276**.

A jet or stream of gas from the engine crankcase is delivered from the nozzle 279 across the aperture 276 and is effective to aspirate fuel into the mixing passage as in the other forms of aspirating nozzle. In the arrangement shown in FIG. 16, the fuel delivery tube shown in the other forms of the invention is eliminated. The aspirating effect of the stream of gas delivered from the nozzle 279 is substantially the same as the aspirating effect of the stream of gas delivered from the nozzle 219 in the form shown in FIG. 6.

Figure 17:
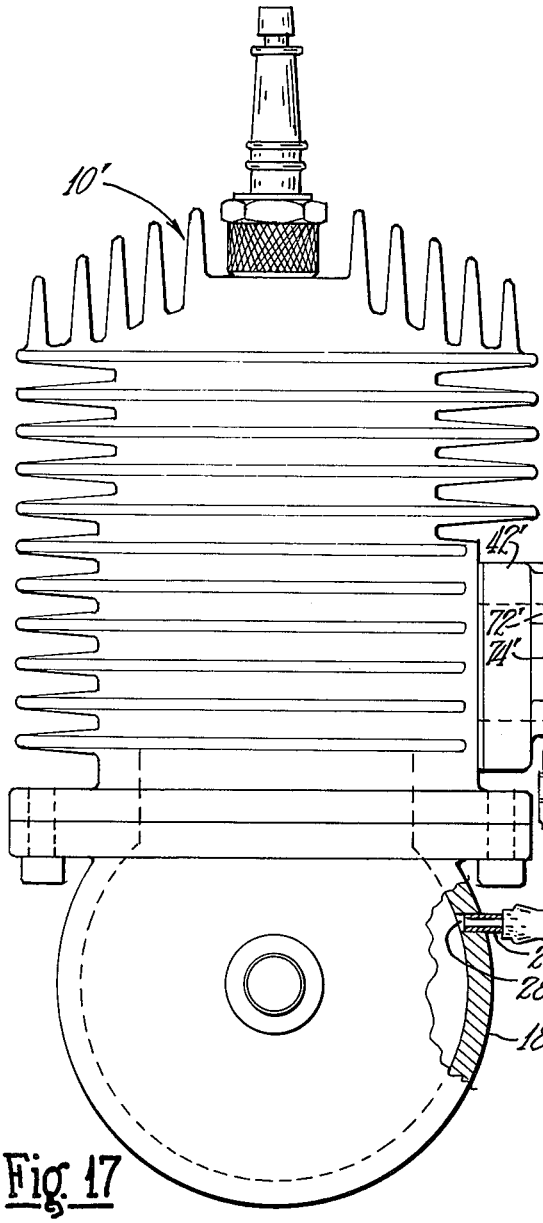
FIG. 17 is a view of a single cylinder two cycle engine and form of carburetor of the invention illustrating an exterior tubular connection of gas passage means for the aspirating nozzle.

FIG. 17 illustrates a single cylinder two cycle engine of the character shown in FIG. 1 in association with a carburetor of the general character of the carburetor shown in FIG. 1 wherein the gas passage system for aspirating fuel from a main orifice or aperture into the mixing passage is provided in part by tubular means exterior of the carburetor and in direct communication with an opening in the crankcase wall of the engine. The engine 10' shown in FIG. 17 is equipped with a carburetor **44*a* which is substantially the same as the carburetor shown in FIGS. 1 through 8**.

The carburetor **44*a* has a mounting flange 42' secured to the engine cylinder. The carburetor has a mixing passage 58' embodying a Venturi configuration including a choke band 61', the mixing passage having an air inlet region 63'. A conventional throttle valve 72' is mounted upon a throttle operating shaft 74'**.

The carburetor **44*a* is fashioned with a raised portion 215*c* in the mixing passage adjacent the main fuel delivery orifice, the portion being provided with a passage 217*c* having a nozzle or outlet 219*c*. The passage 217*c* is in communication with a passage 221*c*. The outer end region of the passage 221*c* opening at the side of the carburetor is threaded to receive a threaded tenon portion of an L-shaped tubular fitting or member 282. The L-shaped fitting has a second tenon portion or projection 284 adapted to receive one end of a tubular means or member 285** fashioned of synthetic rubber or other flexible material.

The wall of the crankcase 18' of the two cycle engine has a bore 287 accommodating a tubular fitting or member 288. The other end of the tubular means or member 285 is telescoped onto the tubular fitting 288. The aspiration gas passage system provides for flow of gases under pressure pulsations from the engine crankcase through the fitting 288, tubular member 285, fitting 282, passages **221*c* and 217*c*, for delivery through the nozzle 219*c* across the main fuel delivery orifice such as the orifice 162 shown in FIG. 6**.

The nozzle construction may be of the character shown at 272 in FIG. 15 or the nozzle construction 279 shown in FIG. 16. In the form of the invention of FIG. 17, the gas from the crankcase under the influence of the pressure pulses flows uninterrupted to the discharge nozzle **219*c***.

Figure 18:
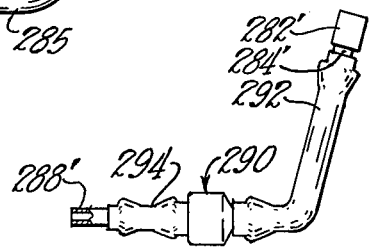
FIG. 18 illustrates an external tubular connection of gas passage means for an aspirating nozzle embodying a one-way or check valve construction.
Figure 19:
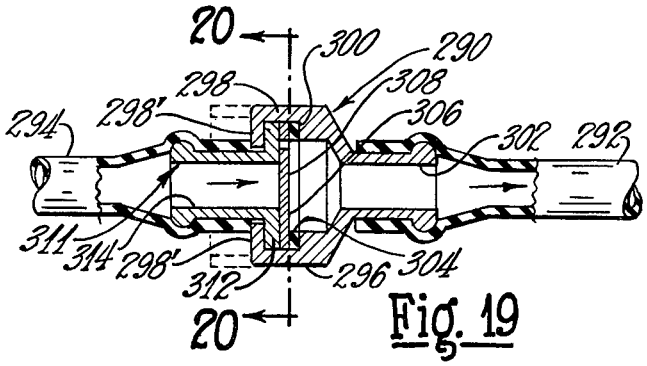
FIG. 19 is a detail sectional view of the check valve construction shown in FIG. 18.

FIGS. 18 and 19 illustrate a tubular means forming a part of the gas passageway system wherein the tubular means exterior of the carburetor is inclusive of two tubular members with a check valve or one-way valve construction 290 intercalated or interposed between the tubular sections. An end of one tubular section 292 is telescoped onto a tenon 284' of the L-shaped tubular fitting 282'. The other tubular member or section 294 is telescoped onto the tubular fitting 288'.

A form of the check valve construction 290 is illustrated in detail in FIG. 19. The check valve construction includes a circular housing 296 having a circular interior chamber defined by a flange portion 298. The housing 296 is fashioned with an inwardly extending ledge or shoulder 300 and a tubular nipple portion or projection 302. The nipple portion 302 telescopingly receives an end region of the tubular means or section 292.

Figure 20:
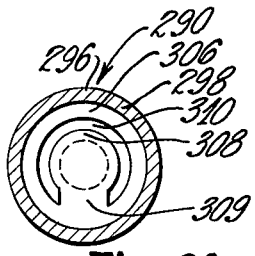
FIG. 20 is a transverse sectional view taken on the line 20—20 of FIG. 19.

Disposed within the housing and engaging the ledge 300 is a sealing member or gasket 304. Disposed contiguous with the sealing member or gasket 304 is a valve means or member 306. The valve member is of circular configuration fitting in the chamber defined by the flange 298. The valve means 306 is fashioned with a flap-like valve portion or valve 308 which is provided by a generally-U-shaped cutaway region 310 as shown in FIG. 20, the flap valve having a bridge or hinge portion 309.

Fitted into the chamber defined by the flange 298 is a tubular member 311 fashioned with an outwardly extending circular flange 312 integral with a tubular tenon or nipple portion 314 of the member 311, the tenon portion telescopingly receiving an end of the tubular section 294. The flange 312 is engaged by an inwardly extending portion 298' to secure the gasket 304, valve member 308 and the flange 312 in assembled relation.

In assembling the components of the valve means or unit 290, the flange portion 298' is in the position shown in broken lines in FIG. 19. The gasket 304, the valve member 306 and the flange 312 are assembled in the position shown in FIG. 19 and the portion 298' of the flange 298 is spun or pressed inwardly into the position shown in full lines.

The gas flow from the engine crankcase is in the direction of the arrows in FIG. 19 whereby the pressure of the gases flexes the valve portion 308 in a right-hand direction permitting the gas to flow past the valve through the cutaway region 310 to the aspirating nozzle in the carburetor. The flap valve portion 308 is comparatively thin and highly flexible so as to be readily opened by the pressure of the gases. The one-way or check valve 308 prevents reverse flow of gases through the passage means during periods of reduced pressure or partial vacuum in the engine crankcase.

Figure 21:
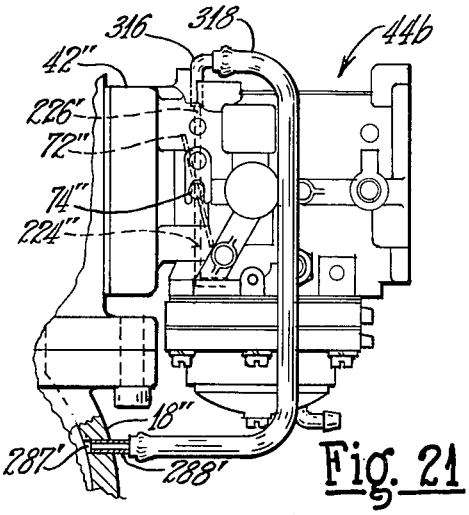
FIG. 21 illustrates a tubular gas passage means exterior of the carburetor for the aspirating nozzle associated with a passage in the throttle shaft.

FIG. 21 illustrates a carburetor **44*b* of the character shown in FIGS. 1 and 17 with a partial external gas passage system for the fuel aspirating nozzle with a valve passage associated with the throttle operating shaft which is effective when the throttle is moved toward open position to effect flow of gas under crankcase pulse pressure to the aspirating nozzle. The carburetor 44*b* has a mounting flange 42" for securing the carburetor to the cylinder of the engine in the manner shown in FIG. 1**.

A throttle valve 72" mounted upon a throttle shaft 74" is disposed in the mixing passage in the carburetor.

The carburetor has vertically aligned passages 224' and 226', the respective passages being below and above the throttle shaft 74''. The throttle shaft has a valve passage of the character shown at 233 in FIG. 9 which, when the throttle 72'' is moved toward open position, is in registration with the passages 224' and 226' to admit flow of gases under pulse pressure from the engine crankcase to an aspirating jet in the carburetor.

The nozzle in the carburetor may be of the form shown in FIG. 6, FIG. 15 or FIG. 16. The upper end of the passage 226' accommodates an L-shaped tubular fitting 316. The wall of the crankcase 18'' of the two cycle engine is provided with a bore 287' accommodating a fitting 288'.

A tubular means or member 318 has its ends telescoped onto the fittings 288' and 316 completing the gas passage system for conveying gas under pulse pressures from the crankcase of the engine to the aspirating jet arranged adjacent the main fuel delivery orifice in the wall of the mixing passage. The tubular means or member 318 is formed of synthetic rubber, plastic or other suitable material. In this form the position of the valve passage in the throttle shaft 74'' controls flow of gases from the engine crankcase to the aspirating nozzle as in the arrangement shown in FIG. 9.

Figure 22:
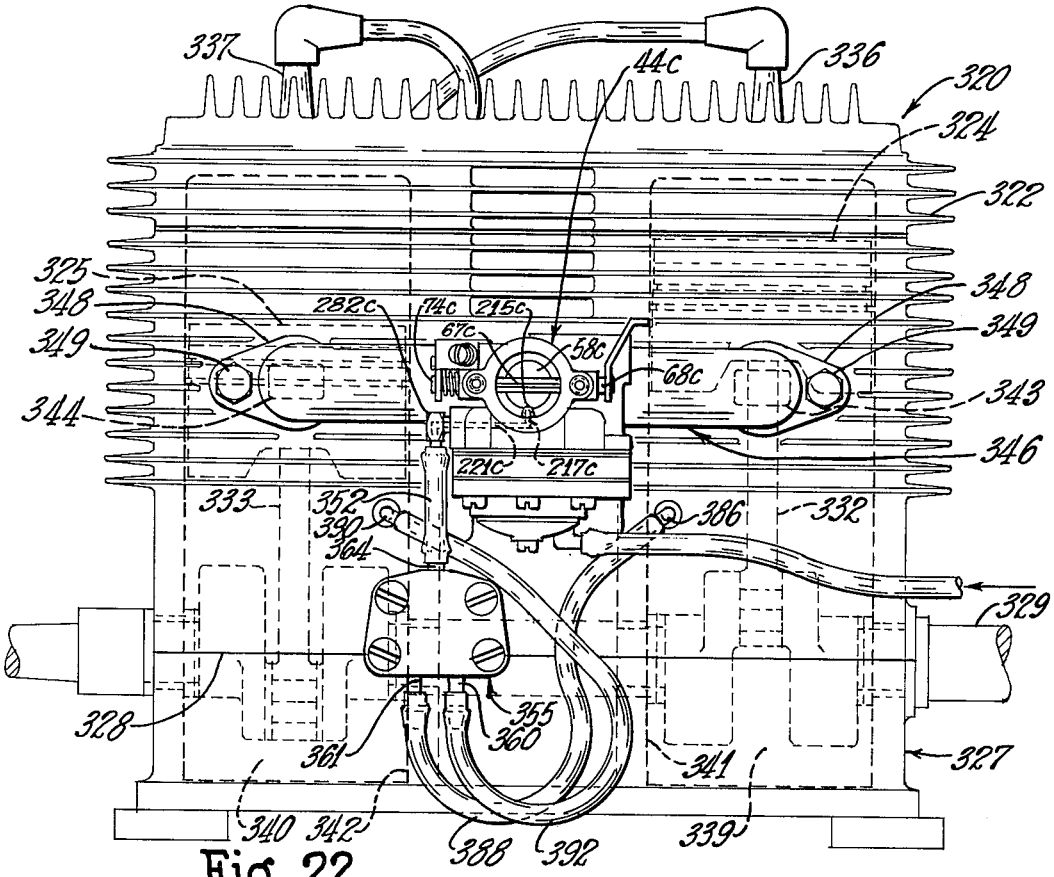
FIG. 22 is a semischematic elevational view of a two cylinder two cycle engine in combination with a carburetor embodying the invention illustrating external gas passage tubes connected with the engine crankcase for conveying gas to the aspirating nozzle.

The invention is usable in a charge forming apparatus or carburetor of a character adapted to supply fuel and air mixture to a multicylinder two cycle engine. FIG. 22 illustrates a carburetor embodying the invention used with a multicylinder two cycle engine. As shown in FIG. 22, the engine 320 is inclusive of a cylinder block 322 having two cylinder chambers accommodating reciprocable pistons 324 and 325. The engine includes a crankcase base construction 327 which is joined with the cylinder block construction at a planar surface indicated at 328.

Crankshaft 329 is journally supported in the crankcase and connecting rods 332 and 333 connect the respective pistons with the crank arms of the crankshaft. Spark plugs 336 and 337 are provided for the respective cylinders for igniting fuel and air mixture in the cylinders.

The engine illustrated is of the two cycle type in which the fuel and air mixture is ignited in each cylinder at each revolution of the crankshaft. The crankcase construction 327 which includes a portion of the cylinder block is fashioned with two crankcase chambers 339 and 340. A wall or partition 341 and an end wall of the crankcase construction provide the compartment or chamber 339, and a wall or partition 342 of the crankcase construction and the other end wall provide the compartment or chamber 340. Thus, a crankcase compartment or chamber is provided for each cylinder.

The respective walls of the cylinders are provided with mixture inlet ports or passages 343 and 344 through which fuel and air mixture is delivered into the respective crankcase chambers when a piston is in its uppermost position such as the position of the right-hand piston 324. As is conventional, the pistons are in opposed relation, that is, one piston is in its uppermost position when the other piston is in its lowermost position.

In the arrangement illustrated in FIG. 22, a fuel and air mixture is supplied to the crankcase chamber of each cylinder by an intake manifold 346 having its end regions registering respectively with the mixture inlet ports 343 and 344. The manifold is provided with mounting flanges 348 secured to the cylinder block by bolts 349. A fuel and air mixture is supplied to the manifold 346 by a single carburetor or charge forming apparatus 44c of the character of the other carburetors illustrated herein and hereinbefore described. The carburetor 44c has a mixing passage 58c, a choke valve 67c mounted on a shaft 68c and a throttle valve mounted on a throttle operating shaft 74c.

The carburetor embodies a raised portion 215c extendinginto the mixing passage 58c. The carburetor body embodies a portion of an aspirating passageway system including a passage 217c in communication with a passage 221c. The exit of passage 217c provides a nozzle from which gas under pressure from the crankcase is delivered across the main fuel orifice such as the orifice 162 shown in FIG. 6. An L-shaped tubular fitting 282c is threaded into the end region of the passage 221c, a tubular tenon or nipple portion of the fitting receiving one end region of a tubular means or member 352.

In the operation of the two cylinder two cycle engine, the downward movement of a piston compresses the fuel and air mixture in the crankcase chamber associated with the cylinder containing the piston. In the arrangement shown in FIG. 22, the gases in the crankcase chambers 339 and 340 under successive pressure pulses provided by reciprocation of the pistons are conveyed to a selector valve, valve means or valve unit 355.

The valve means 355 is provided with two check valves or one-way valves which are alternately opened by successive pulse pressures from the respective crankcase chambers so that a substantially continuous flow of gases is delivered from the aspirating nozzle adjacent the main fuel delivery orifice or aperture.

The valve arrangement 355 is inclusive of a housing 357 equipped with a cover or closure 358. The one side surface of the housing 357 is fashioned with two tubular projections or nipple portions 360 and 361 providing passages 362 and 363. The opposite side of the housing has a tubular projection or nipple portion 364 providing a passage 365. A passage 368 in the housing 357 is in communication with the passage 362 in the tubular projection 360. A passage 369 in the housing 357 is in communication with the passage 363 in the tubular projection or nipple portion 361. The housing 357 has a passage 372 which is in communication with the passage 365 in the tubular projection 364.

The cover or closure 358 is fashioned with a recess or chamber 374 configurated to establish communication of each of the passages 368 and 369 with the passage 372. Disposed contiguous with a planar surface 375 of the housing 357 is a valve means or member 376 of flexible material such as synthetic rubber or the like. The valve means 376 is fashioned with flap valve portions 377 and 378. The flap valve 377 normally closes the passageway 368, and the flap valve 378 normally closes the passageway 369.

Figure 25:
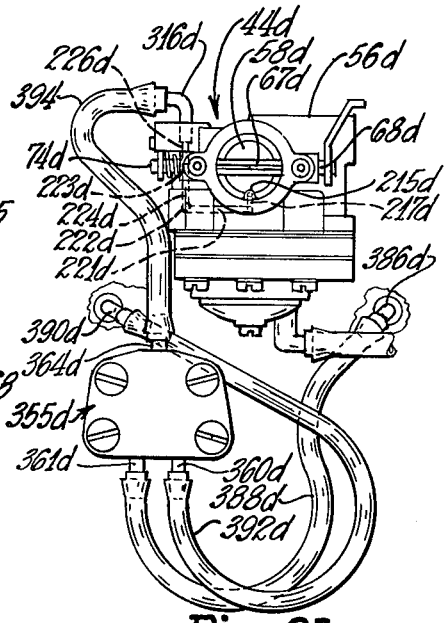
FIG. 25 is a view of a carburetor and gas passage arrangement for the aspirating nozzle similar to the arrangement shown in FIG. 22 and wherein the aspirating gas for the nozzle flows through a passage in the throttle shaft.

A sealing gasket 380 is disposed between the cover or closure 358 and the valve member 376, the gasket being cut away as at 382 registering with the recess or chamber 374. The cover 358, the valve member 376 and the gasket 380 have registering openings accommodating screws 384 extending into threaded openings in the housing 357 for securing these components in assembled relation as shown in FIG. 25.

As shown in FIG. 22, the other end region of tube 352 is telescoped over the nipple portion 364. A wall region of the crankcase construction defining the compartment or chamber 339 is provided with an opening accommodating a tubular fitting or coupling 386, and a tubular means or member 388 is connected with the fitting 386 and the fitting 361 of the valve construction.

A wall region of the crankcase construction defining the chamber 340 is provided with an opening accommodating a tubular fitting or coupling 390. One end region of a flexible tube or member 392 is connected with the tubular fitting 390, the other end region of the tubular member 392 being connected with the tubular fitting 360 as shown in FIG. 22. The valve means or member 376 is fabricated of comparatively thin and highly flexible material so that the flap valve portions 377 and 378 are readily flexed to open positions by gas pressure pulses from the crankcase.

Figure 23:
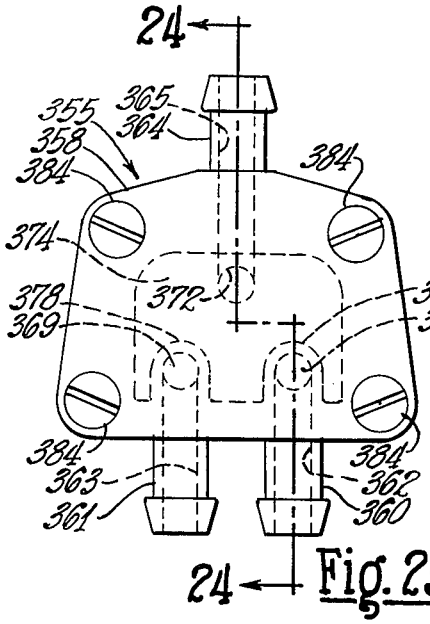
FIG. 23 is a view of a selector valve associated with the gas passage tubes connected with the engine crankcase.
Figure 24:
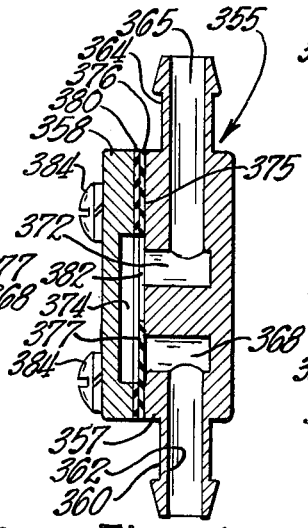
FIG. 24 is a sectional view taken substantially on the line 24—24 of FIG. 23.

The operation of the arrangement shown in FIGS. 22 through 24 is as follows: During an upward movement of a piston of the engine, for example, piston 324, a partial vacuum or reduced pressure is developed below the piston in the crankcase compartment 339 and mixture of fuel and air from the carburetor 44*c* is aspirated through the inlet port 343 into the crankcase compartment 339.

Upon downward movement of the piston 324, the fuel and air mixture in the crankcase is compressed and is transferred through a port (not shown) into the combustion chamber above the piston. Concomitantly the pressure pulses developed in the crankcase compartment are transmitted through the fitting 386, tubular member 388, fitting 361 and passage 69 to the region of the flap valve 378.

The gases under the pressure pulses in the crankcase chamber 339 flow through the tube 388 past the flap valve 378 into the recess 374 in the housing cover 358 through passage 372, passage 365 in the nipple portion 364, through the tube 352, fitting 282*c* and passages 221*c* and 227*c* and are delivered as a jet or stream of gases from the nozzle exit of the passage 217*c* across the main fuel delivery orifice, such as the orifice 162 in FIG. 6, to aspirate fuel from the orifice.

The corresponding movements of the piston 325 occur in opposed directions by reason of being connected with the crankshaft one hundred eighty degrees from the connection of the piston 324 with the crankshaft. Hence, downward movement of the piston 325 occurring simultaneously with the upward movement of the piston 324 compresses the fuel and air mixture in the crankcase compartment 340, and the gases in the crankcase under pressure are conveyed through the fitting 390, flexible tube 392, fitting 360 and passage 368 to the region of the flap valve 377.

The flap valve 377 is opened under the pressure pulses and gas flows through the recess 374, passage 327, fitting 364 and tube 358 into the passages 221*c* and 217*c* for delivery from the nozzle to aspirate fuel out of the main fuel delivery orifice into the mixing passage. In the use of a single charge forming apparatus or carburetor 44*c* with a two cylinder-two cycle engine, a substantially continuous flow of gases to the aspirating nozzle from the respective crankcase compartments or chambers is maintained so that the jet or stream of gases delivered from the nozzle or exit of passage 217*c* is effective to substantially continuously aspirate fuel from the main fuel delivery orifice or aperture.

Thus, when the throttle is moved from an idling position toward open position, the speed of the engine increases and is accelerated because the pressures in the crankcase increase with the engine speed and there is developed a high velocity stream of crankcase gases flowing across the main fuel delivery orifice from the aspirating nozzle and the enriched mixture established by the jet aspiration of fuel from the orifice is instantly effective to rapidly increase or accelerate the speed of the engine.

As the engine speed increases, the air velocity through the mixing passage of the carburetor increases and the aspirating effect of the air flow through the mixing passage becomes the higher of the two fuel aspirating forces and is the aspirating force withdrawing fuel from the main fuel delivery aperture at high engine speeds. While the stream of gases or jet of gases from the aspirating nozzle may continue to flow at high engine speeds, it is not an aspirating force additive to the higher aspirating force of the normal air flow through the mixing passage.

FIG. 22 is illustrative of a single charge forming apparatus or carburetor embodying the invention with a two cylinder-two cycle engine, but it is to be understood that a single carburetor or charge forming apparatus may be used with a two cycle engine having more than two cylinders. In such an arrangement, the valve unit 355 is equipped with the number of flap valves equal to the number of crankcase compartments or chambers in combination with a tubular means connecting the valve unit with each of the crankcase chambers or compartments.

FIG. 25 illustrates an arrangement similar to that shown in FIG. 22 wherein the aspirating gas passage system of the charge forming apparatus or carburetor is modified so that gas flow from the engine crankcase compartments or chambers is controlled by means associated with the throttle-supporting shaft. The charge forming apparatus or carburetor 44*d* has a mixing passage 58*d* and a choke valve 67*d* mounted upon a choke valve shaft 68*d*. The mixture outlet region is provided with a conventional throttle valve mounted upon a shaft 74*d*.

The carburetor body 56*d* is provided with aligned passages 224*d* and 226*d* below and above the throttle shaft 74*d*. The throttle shaft is provided with a passage 233*d* which, when the throttle is moved toward open position, registers with passages 224*d* and 226*d* to provide passage means for gases from the crankcase chambers to flow to the aspirating nozzle. The upper end of the passage 226*d* accommodates an L-shaped tubular fitting 316*d* to which is connected one end of a flexible tubular means or member 394. The other end of the tubular means 394 is connected to a tubular projection or nipple portion 364*d* of a valve unit 355*d*.

A wall region of one crankcase compartment or chamber of a two-cycle engine, such as shown in FIG. 22, has an opening accommodating a tubular member or coupling 386*d* and a tubular means or member 388*d* is connected with a tubular member 386*d* and the tubular projection 361*d* of the valve construction 355*d*. A wall region of the other crankcase compartment or chamber is provided with an opening accommodating a tubular member or coupling 390*d*.

One end region of a flexible tube or tubular means 392*d* is connected with the tubular member 390*d*, the other end region of the tubular means 392*d* being connected with the tubular projection or member 360*d*. The passage 224*d* is in communication with a passage 222*d* in the carburetor body 56*d* extending parallel with the axis of the mixing passage.

The passage 222*d* is in communication with a transverse passage 221*d* which is in communication with passage 217*d*, the exit or outlet of passage 217*d* being the gas discharge nozzle in a raised portion 215*d* extending into the mixing passage in the manner illustrated at 215 in FIG. 6. The nozzle provided by the outlet of passage 217*d* is arranged to direct a stream of gases from the crankcase compartments or chambers across the main fuel delivery aperture or orifice to aspirate fuel into the mixing passage 58*d*.

In the arrangement illustrated in FIG. 25, with the throttle valve in near closed or engine idling position, the passage or valve port 233*d* in the throttle shaft 74*d* is in a position to interrupt flow of crankcase gases to the aspirating nozzle. Upon opening movement of the throttle valve, the passage 233*d* is brought into registration with the passages 224*d* and 226*d* whereby gases from the crankcase chambers or compartments flow past the flap valve means contained within the valve unit 355*d* and through the tube 394 into the passage system within the carburetor body 56*d* providing a high velocity jet or gas stream from the exit of the passage 217*d* aspirating fuel into the mixing passage from the main fuel orifice adjacent the aspirating nozzle.

In this form, with the throttle valve in near closed or engine idling position, the valve port or passage 233 in the throttle shaft is out of registration with the passages 224*d* and 226*d* to interrupt or impede flow of gases to the aspirating nozzle. As the throttle valve is moved toward open position providing gas flow from the crankcase compartments to the aspirating nozzle, the flow of crankcase gases from the crankcase compartments or chambers to the aspirating nozzle is substantially continuous so that fuel is aspirated into the mixing passage of the carburetor and into the engine enriching the mixture to rapidly accelerate the speed of the engine.

While the invention has been shown and described as embodied in a diaphragm-type carburetor, it is to be understood that the aspirating jet system may be embodied in a charge forming apparatus or carburetor of the float bowl type in which fuel flow into a fuel chamber is controlled by a float-operated valve.

It is apparent that, within the scope of the invention, modifications and different arrangements may be made other than as herein disclosed, and the present disclosure is illustrative merely, the invention comprehending all variations thereof.

I claim:

1. A method of effecting delivery of fuel through an aperture from a fuel chamber into an air and fuel mixing passage of a charge forming apparatus having a throttle valve in the mixing passage including regulating flow of liquid fuel from a supply into the fuel chamber, delivering fuel by aspiration in the mixing passage from the fuel chamber through the aperture into the air and fuel mixing passage when the air flow in the mixing passage is of sufficient velocity to aspirate fuel from the aperture, and projecting gases from a nozzle across the aperture to effect aspiration of additional fuel from the aperture into the mixing passage when the air flow in the mixing passage is at a low velocity.

2. A method of effecting delivery of fuel through an aperture from a fuel chamber into an air and fuel mixing passage of a charge forming apparatus of the diaphragm type having a throttle valve in the mixing passage including regulating flow of liquid fuel from a supply into the fuel chamber, delivering fuel by aspiration in the mixing passage from the fuel chamber through the aperture into the air and fuel mixing passage when the air flow in the mixing passage is of sufficient velocity to aspirate fuel from the aperture, and projecting gases from a nozzle across the aperture to effect aspiration of additional fuel from the aperture into the mixing passage when the air flow in the mixing passage is at a low velocity.

3. A method of effecting delivery of fuel and air mixture from a charge forming apparatus having a fuel chamber and a mixing passage to a two cycle internal combustion engine having a crankcase compartment including delivering liquid fuel from the fuel chamber through an aperture into the mixing passage of the charge forming apparatus providing a fuel and air mixture, delivering fuel and air mixture from the mixing passage into the crankcase compartment for transfer into the engine cylinder, and projecting gases from the crankcase compartment through a nozzle across the fuel delivery aperture for aspirating additional fuel into the mixing passage for enriching the fuel and air mixture.

4. A method of effecting delivery of fuel and air mixture from a charge forming apparatus having a fuel chamber and a mixing passage to a multicylinder two cycle internal combustion engine having crankcase compartments individual to the cylinders including delivering liquid fuel by aspiration in the mixing passage from the fuel chamber through an aperture into the mixing passage of the charge forming apparatus providing a fuel and air mixture, delivering fuel and air mixture from the mixing passage into the crankcase compartments for transfer from the crankcase compartments into the engine cylinders, and projecting gases from the crankcase compartments through a nozzle and across the fuel delivery aperture for aspirating additional fuel into the mixing passage for enriching the fuel and air mixture.

5. A system for delivering fuel and air mixture to a two cycle internal combustion engine having a crankcase including a carburetor body having a mixing passage and a fuel delivery aperture opening into the mixing passage and a throttle valve in the mixing passage, the body including a fuel chamber, a fuel inlet valve for regulating fuel flow from a supply into the chamber, fuel from the chamber being delivered through the aperture into the mixing passage by crankcase aspiration, a nozzle in the mixing passage disposed adjacent the fuel delivery aperture, and passage means in communication with the nozzle and the crankcase of the engine for conveying gases under pulse pressures from the crankcase for delivery from the nozzle across the aperture for aspirating additional fuel from the aperture into the mixing passage.

6. A system for delivering fuel and air mixture to a two cycle internal combustion engine having a crankcase including a carburetor body having a fuel delivery aperture opening into a mixing passage and a throttle valve in the mixing passage mounted upon a shaft, the throttle valve being movable from a closed to an open position, the body including a fuel chamber, a fuel inlet valve for regulating fuel flow from a supply into the chamber, fuel from the chamber being normally delivered from the chamber through the aperture into the mixing passage under the influence of crankcase aspiration, a nozzle in the mixing passage disposed adjacent the fuel delivery aperture having its axis substantially normal to the axis of the aperture, passage means in communication with the nozzle and the crankcase of the engine for conveying gases under pulse pressures from the crankcase of the engine for delivery from the nozzle across the aperture, and valve means for said gas passage means whereby gases under pulse pressures from the crankcase are projected from the nozzle across the aperture when the throttle valve is moved from closed position toward open position to deliver additional fuel through the aperture into the mixing passage.

7. The system according to claim 6 wherein the valve means for the gas passage means includes a transverse passage through the throttle supporting shaft.

8. The system according to claim 6 wherein the valve means comprises a member normally impeding the flow of gas through the passage means when the throtte valve is in closed position, said valve member being arranged to be opened when said throttle valve is moved toward open position.

9. The system according to claim 6 wherein the gas passage means comprises in part a tubular member exteriorly of the carburetor and connected with the engine crankcase.

10. In a carburetor system for a two cycle internal combustion engine having a crankcase including a carburetor body having a fuel and air mixing passage, a main fuel delivery aperture and an engine idling fuel delivery aperture opening into the mixing passage, a shaft supporting a throttle in the mixing passage movable from an engine idling position to an open position, said body including a fuel chamber, a fuel inlet valve for regulating fuel flow from a supply into the chamber, fuel being normally delivered through the main aperture by aspiration in the mixing passage, a nozzle in the mixing passage disposed adjacent the main fuel delivery aperture, passage means in communication with the nozzle and the engine crankcase for conveying gases under pulse pressures in the engine crankcase to the nozzle, valve means for said gas passage means associated with the throttle, said valve means impeding flow of gases through the gas passage means when the throttle is in engine idling position, said valve means being opened when the throttle valve is moved toward open position whereby gases from the engine crankcase are projected from the nozzle across the main fuel delivery aperture to aspirate additional fuel into the mixing passage to enrich the fuel and air mixture for accelerating the engine.

11. A system for delivering fuel and air mixture from a charge forming apparatus to crankcase compartments of a multicylinder two cycle engine including a charge forming apparatus having a body, a mixing passage in the body, means including a manifold for delivering fuel and air mixture to the crankcase compartments, a movable throttle valve in the mixing passage, said charge forming apparatus having a fuel chamber, an aperture for normally delivering fuel from the fuel chamber into the mixing passage under the influence of aspiration from the crankcase compartments, a nozzle opening into the mixing passage adjacent the aperture, and passage means for conveying gases under pressure from the crankcase compartments to the nozzle whereby the gases are projected from the nozzle across the aperture for aspirating additional fuel from the aperture into the mixing passage.

12. The system according to claim 11 wherein the gas conveying means includes check valve means, tubular means connecting the check valve means with each of the crankcase compartments, a tubular member connected with the body and the check valve means for conveying gases to the nozzle in the mixing passage, said check valve means being adapted to prevent reverse flow of gases through the tubular means into the crankcase compartments.

13. The system according to claim 12 wherein the check valve means includes an enclosure, a valve member of flexible material in the enclosure having flap valve portions, said enclosure having passages in communication with the tubular means, said flap valve portions cooperating with said passages to prevent reverse flow of gases into the crankcase compartments.

14. A system for delivering fuel and air mixture from a charge forming apparatus to crankcase compartments of a multicylinder two cycle engine including a charge forming apparatus having a body, means including a manifold for delivering fuel and air mixture to the engine crankcase compartments, said charge forming apparatus having a mixing passage and a movable throttle valve in the mixing passage, said charge forming apparatus having a fuel chamber, an aperture for delivering fuel from the fuel chamber into the mixing passage under the influence of aspiration in the mixing passage, a nozzle opening into the mixing passage adjacent the aperture and having its axis substantially normal to the axis of the aperture, passage means for conveying gases under pulse pressures from the crankcase compartments to the nozzle whereby the gases are projected from the nozzle across the aperture for aspirating additional fuel from the aperture into the mixing passage, the gas conveying passage means including a passageway interiorly of the body, tubular means connecting the passageway in the body with the crankcase compartments, valve means for said gas passage means associated with the throttle valve normally impeding flow of gases to the nozzle when the throttle valve is in substantially closed position, the valve means being opened when the throttle valve is moved toward open position whereby gases from the crankcase compartments are projected from the nozzle across the aperture.

15. The system according to claim 14 including check valve means associated with the tubular means for preventing reverse flow of gases in said gas conveying passage means.

16. Charge forming apparatus including, in combination, a body construction provided with a fuel and air mixing passage and a fuel chamber, a throttle in the mixing passage, valve means for regulating fuel flow from a supply into the fuel chamber, an aperture opening into the mixing passage for delivering fuel through the aperture into the mixing passage by aspiration when the air flow in the mixing passage is of sufficient velocity to aspirate fuel from the aperture, a raised boss extending inwardly from the wall of the mixing passage and terminating adjacent the aperture, gas passage means in said boss, the boss having an exit opening into the mixing passage adjacent the fuel delivery aperture, the axis of the exit being substantially normal to the axis of the aperture, said gas passage means arranged to be connected with a source of gas under pressure whereby the velocity of the gas flowing from the exit of the passage means effects aspiration of additional fuel from the aperture into the mixing passage when the air flow in the mixing passage is at a low velocity.

17. Charge forming apparatus for use with a two cycle engine including, in combination, a body construction provided with a fuel and air mixing passage and a fuel chamber, a throttle in the mixing passage, valve means for regulating fuel flow from a supply into the fuel chamber, an aperture opening into the mixing passage for normally delivering fuel under the influence of engine aspiration from the fuel chamber into the mixing passage, a nozzle opening into the mixing passage having its exit disposed adjacent the aperture, the axis of the nozzle being substantially normal to the axis of the aperture, and gas passage means for establishing communication of the nozzle with the engine crankcase, said nozzle being arranged to project gases from the crankcase across the aperture to aspirate additional fuel from the aperture into the mixing passage.

18. Charge forming apparatus for use with an internal combustion engine of the two cycle type including a body construction provided with a fuel and air mixing passage and a fuel chamber, a throttle in the mixing passage, means for regulating fuel flow from a supply into the fuel chamber, an aperture opening into the mixing passage for normally delivering fuel under the influence of engine aspiration from the chamber into the mixing passage, a raised boss on a wall of the mixing passage adjacent the aperture, gas passage means in said body construction and said raised boss, said gas passage means having an exit in the raised boss opening into the mixing passage and directed downstream of the mixing passage whereby gases projected from the exit of the passage means flow across the fuel delivery aperture, said gas passage means arranged to be connected with the crankcase of the engine whereby gases under pressure pulses in the engine crankcase projected from the exit of the passage means aspirate additional fuel from the aperture into the mixing passage for accelerating the speed of the engine.

19. The apparatus according to claim 18 including check valve means associated with the gas passage means to prevent reverse flow of gas through the passage means.

20. In combination with a charge forming apparatus for use with a two cycle internal combustion engine having a crankcase compartment, said charge forming apparatus having a fuel and air mixing passage and a fuel chamber, a throttle in the mixing passage, means for regulating fuel flow from a supply into the fuel chamber, an aperture opening into the mixing passage for delivering fuel into the mixing passage under the influence of aspiration in the mixing passage, gas passage means having a nozzle opening into the mixing passage adjacent the fuel delivery aperture, said gas passage means including a tubular member exterior of the charge forming apparatus for establishing communication between the nozzle and the crankcase compartment whereby gases under pressure pulses from the crankcase compartment are projected from the nozzle across the aperture for aspirating additional fuel from the aperture to enrich the mixture in the mixing passage.

21. Charge forming apparatus for use with a two cycle internal combustion engine having a crankcase compartment including, in combination, a body construction provided with a fuel and air mixing passage and a fuel chamber, a throttle in the mixing passage, a diaphragm forming a wall of the fuel chamber, means actuated by the diaphragm for regulating fuel flow from a supply into the fuel chamber, an aperture opening into the mixing passage for normally delivering fuel from the fuel chamber into the mixing passage under the influence of engine aspiration, a raised boss extending inwardly from the wall of the mixing passage and terminating adjacent and upstream of the aperture, gas passage means in the body and in the raised boss having its exit in the boss on an axis substantially normal to the axis of the fuel delivery aperture, said gas passage means adapted to be connected with the crankcase compartment whereby gases under pressure pulses from the crankcase compartment are projected from the exit of the passage means across the aperture for aspirating additional fuel from the aperture to enrich the mixture in the mixing passage.

* * * * *